US006220313B1

(12) United States Patent
Estlander

(10) Patent No.: US 6,220,313 B1
(45) Date of Patent: Apr. 24, 2001

(54) BULK DISPENSER

(76) Inventor: Peter Estlander, Prinsgatan 25, 374 33 Karlshamn (SE)

( * ) Notice: Subject to any disclaimer, the term of this patent is extended or adjusted under 35 U.S.C. 154(b) by 0 days.

(21) Appl. No.: 09/401,058

(22) Filed: Sep. 22, 1999

Related U.S. Application Data

(63) Continuation of application No. PCT/SE98/00283, filed on Feb. 18, 1998.

(30) Foreign Application Priority Data

Mar. 24, 1997 (SE) ..... 9701048

(51) Int. Cl.[7] ..... B65B 1/04; B65B 3/04; B67C 3/00

(52) U.S. Cl. ..... 141/313; 141/311 R; 141/317; 222/153.13; 222/181.1; 222/517; 222/533; 222/536

(58) Field of Search ..... 141/114, 291, 141/311 R, 313, 317; 222/153.13, 180–185.1, 231, 233, 236, 517, 557, 530, 533, 536, 538

(56) References Cited

U.S. PATENT DOCUMENTS 2,532,698 * 12/1950 Corkins ..... 222/135
2,973,110 * 2/1961 Gentle ..... 222/182
4,511,067 * 4/1985 Martin et al. ..... 222/230
4,718,578 1/1988 Radek et al. .
5,873,396 * 2/1999 Biebrach et al. ..... 141/231

FOREIGN PATENT DOCUMENTS 56 805/80 10/1981 (AU) .
0 286 194 10/1988 (EP) .
2 241 696 9/1991 (GB) .
355 935 5/1973 (SE) .
502 253 9/1995 (SE) .
94/13536 6/1994 (WO) .

* cited by examiner

*Primary Examiner*—Timothy L. Maust
(74) *Attorney, Agent, or Firm*—Luedeka, Neely & Graham, P.C.

(57) ABSTRACT

A dispenser for bulk goods comprises a storage container, and a discharge device connected thereto, a dosing means and a discharge chute extending to a collecting point. The dosing means comprises a valve flap which is pivotable between a closing position and a discharge position. An operating device is adapted to pivot the valve flap between said two positions. A locking device prevents the valve flap from pivoting from the closing position to the discharge position in the absence of a collecting receptacle or bag at the collecting point. Preferably, the operating device comprises two operating handles which are operatively connected to the valve flap for pivoting thereof. In this operative connection, a sensor mechanism is included, which permits power transfer merely in essentially parallel or synchronous actuation of the operating handles.

10 Claims, 4 Drawing Sheets

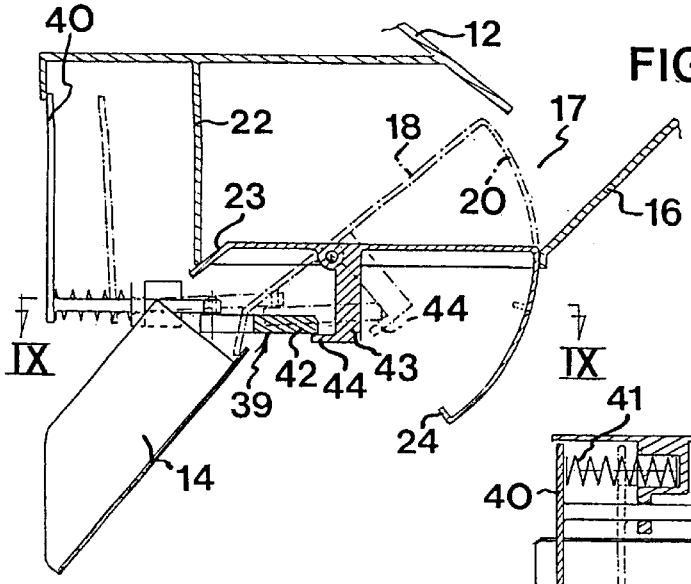
FIG.8
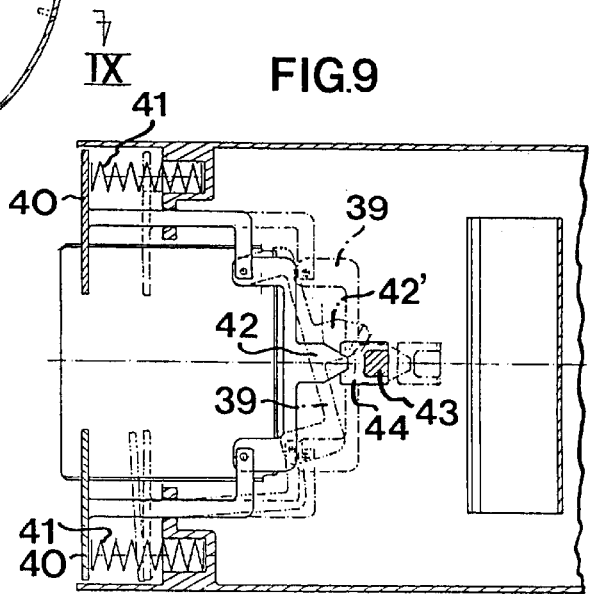
FIG.9
FIG.7
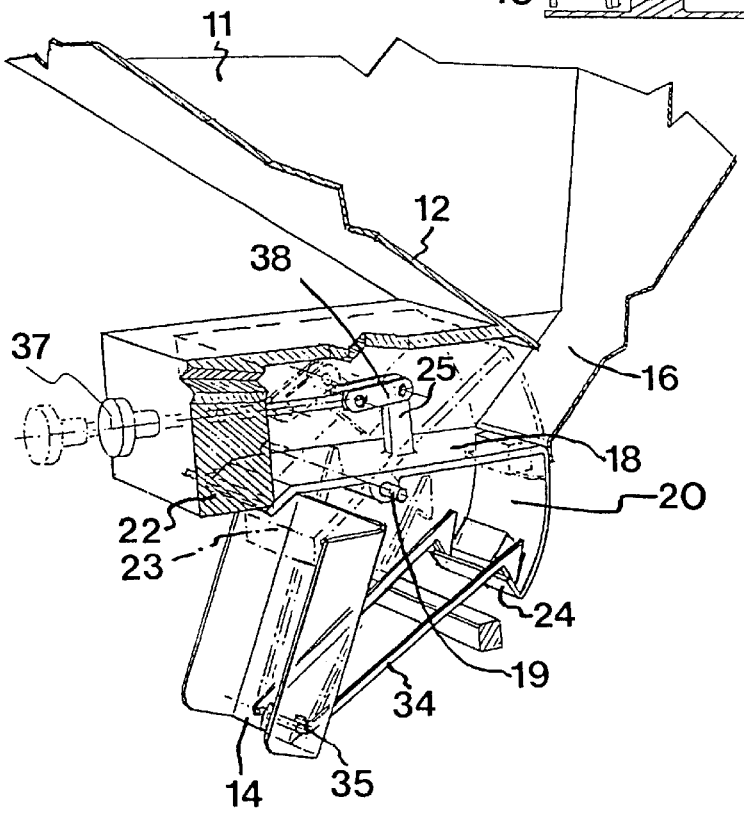

BULK DISPENSER

This application is continuation of international application number PCTE98/00283, filed Feb. 18, 1998, (status, abandoned, pending, etc.).

BACKGROUND OF THE INVENTION

In grocer's shops, goods are more and more frequently sold in bulk to satisfy the requirements that the amount of packings be reduced. The handling of foodstuffs in bulk (for instance beans, tea, flakes and grain) today takes place but to a limited extent. In many cases, open containers are used, from which the customer scoops bulk goods into a bag. Alternatively, the containers have discharge valves which require two movements of the hand, i.e. one for opening and another for closing. This arrangement causes spillage and hygienic inconvenience.

PCT Publication WO 94/13536 shows and discloses a method and an apparatus for distributing bulk articles. A mobile dispenser is charged with the bulk article and is then placed in a location where a customer or user is intended to fill a bag or some other packing with the bulk article in question. The dispenser has a storage container which is intended for the bulk article and which at its lower end has an outlet valve. When the outlet valve opens, the bulk article slides under the action of gravity downwards along an inclined plane to a cellular feeder or intermediate storage unit which is essentially circular-cylindrical in cross-section. When discharging the bulk article, a valve plate included in the cellular feeder is pivoted upwards through the actual bulk article body to interrupt the flow of bulk article down into the bag or packing. The publication indicates safety devices for preventing the cellular feeder from being emptied if a suitable bag or some other suitable packing is not available for reception of the discharged quantity of bulk article. This prior-art apparatus suffers from the drawback that the arcuate valve plate of the cellular feeder, during operation of the cellular feeder, must be pressed upwards through the bulk goods on the inclined plane. During its movement, the front edge of the valve plate hits the particles which therefore counteract a continued movement. In many types of bulk goods, the resistance to the movements of the cellular feeder can be so great that the customers find it inconvenient or impossible to use the dispenser on their own.

EP-A-0 286 194 discloses a different bulk goods dispenser, in which a slide valve is used to discharge bulk goods from the lower end of a storage container. The slide valve has a slide with a compartment which is open upwards and downwards and which can be moved from a filling position to an emptying position and whose bottom in the closed position of the valve is formed of a bottom surface in the storage container. In the emptying procedure, the compartment is pulled out from the container, such that the goods enclosed in the compartment can fall down through a discharge nozzle. When pulling out the slide valve there is a great risk of particles of the bulk goods being pinched between the slide valve and an edge of the bottom of the storage container.

SE-B-355,935 shows and discloses a storage device with a dispenser for particulate bulk goods, in which a reciprocating cellular feeder of a similar type is used. This known dispenser suffers from the same drawbacks.

AU-A1-56805/80 shows and discloses a storage and dispenser apparatus which is particularly intended for packets of cigarettes and the like and which also has a reciprocating slide. This slide has a recess whose shape corresponds to the shape of the package and which is open downwards in order to hand over, after the movement to the emptying position, the packet of cigarettes or the like to a discharge chute or a discharge compartment. A similar device is disclosed in SE-B-502,253. These prior-art devices are not adapted for distribution of the type of bulk goods involved in the present case.

SUMMARY OF THE INVENTION

An object of the present invention is to enable the selling of bulk goods in self-service shops and to achieve a reduction of the amount of packings while at the same time the bulk article is handled hygienically and is stored in a space which is closed and inaccessible.

A further object of the invention is to obviate or essentially reduce the drawbacks of the prior-art dispensers.

According to the invention, these and other objects are achieved by a dispenser having the features stated in independent claim 1. The dependent claims define particularly preferred embodiments of the invention.

Summing up, the invention resides in a dispenser for bulk goods having a storage container, a discharge device connected thereto, a dosing means and a discharge chute extending to a collection point. The dosing means includes a valve flap which is pivotable between a closing position and a discharge position. An operating device is adapted to pivot the valve flap between its said two positions. A locking means prevents the valve flap from pivoting from the closing position to the discharge position when a collecting receptacle or bag is not available at the collecting point. Preferably, the operating device comprises two operating handles, which are operatively connected to the valve flap for pivoting thereof. This operative connection includes a sensor mechanism, which allows power transfer merely when actuating the operating handles essentially in parallel or synchronously.

BRIEF DESCRIPTION OF THE DRAWINGS

Some embodiments of the invention will now be described in more detail with reference to the accompanying drawings, in which FIG. 7 illustrates a third embodiment of a dispenser according to the present invention, FIG. 8 is a vertical section of a discharge valve and the associated operating mechanism in a fourth embodiment of the invention, FIG. 9 is a sectional view along line IX—IX in FIG. 8.

DETAILED DESCRIPTION OF THE PREFERRED EMBODIMENT

Figure 2:
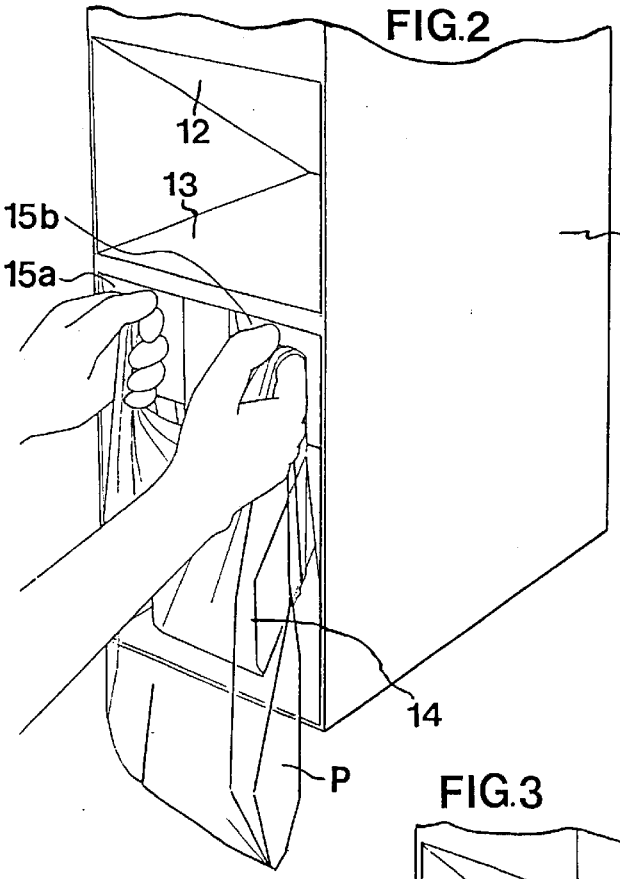
FIG. 2 shows the lower part of this dispenser while filling a bag with bulk goods.
Figure 1:
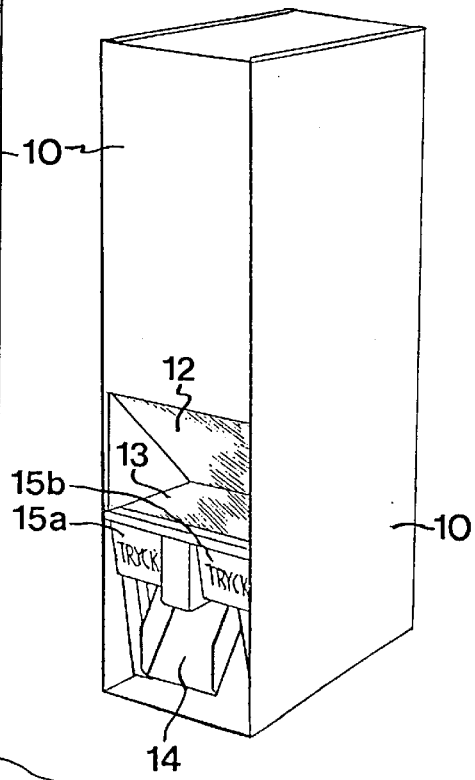
FIG. 1 is a schematic perspective view of a first embodiment of a dispenser according to the present invention.
Figure 3:
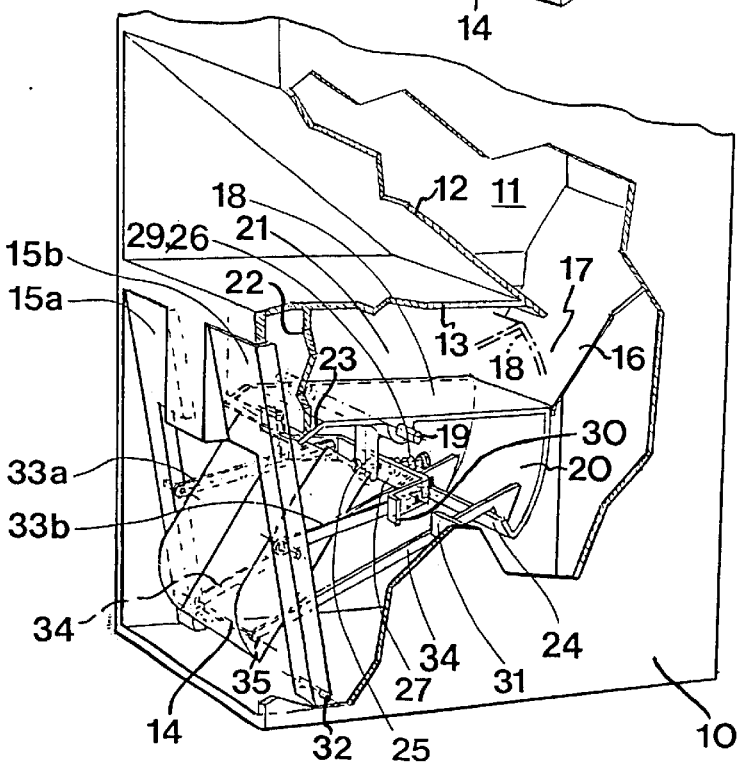
FIG. 3 is a sectional perspective view of the inner structure of said dispenser.

The embodiment of an inventive dispenser as shown in FIGS. 1–3 comprises a casing 10, which can be placed on a mobile frame or have a wheel frame of its own so as to be movable from a storage room to a position of use in a shop. The casing accommodates a container 11, which at the bottom at the front of the dispenser has an inclined and transparent bottom surface 12. There is an inwardly directed wall surface 13 below the bottom surface 12. The wall surface 13 can be reflective like a mirror to make it easier for a customer to inspect the bulk goods before discharging them from the dispenser.

At the bottom there is a discharge chute 14 and two operating buttons or handles 15*a*, 15*b*. For transferring bulk goods from the dispenser to a plastic bag P, it is necessary for the opening of the bag to be slipped onto the discharge chute 14 and for the bag to be pulled upwards for releasing a filling-preventing means (to be described below). Moreover, the two operating buttons 15*a*, 15*b* must be pressed for the discharge through the discharge chute to take place. The mechanisms and the operating means for achieving this result will be described below.

As is evident from FIGS. 1–3, the container 11 in the dispenser according to this embodiment has an additional inclined surface 16, which together with the surface 12 forms a funnel-shaped inlet of an opening 17. A valve flap 18 included in a discharge valve is mounted to be pivoted about a pin 19 fixed to the casing 10. At the rear edge of the valve flap there is a downwardly directed circular-arc-shaped flange 20, which, when pivoting the valve flap to an emptying position (indicated by dash-dot lines in FIG. 3), essentially closes the opening 17 to prevent bulk goods from continuing to flow from the container 11 to a discharge pocket or dosing compartment 21. At the front the pocket is defined by a wall 22 which is directed downwards from the mirror surface or wall 13. The valve flap front edge 23, which can be inclined downwards in the manner shown, engages the lower edge of this wall when the valve is located in its raised resting position (full lines in FIG. 3). The discharge valve therefore comprises the valve flap and its inclined front edge as well as the lower edge of the wall 22. At the lower edge of the arcuate flange 20 of the valve flap there is an upwardly bent flange portion 24 intended for a purpose that will be described below.

A downwardly projecting operating arm 25 of the valve flap 18 has a backwards projecting bearing pin 26 for an operating yoke 27. The yoke 27 is pivotally mounted on this bearing pin by the pin extending through a knife edge hole. In the embodiment according to FIG. 3 there is a compression spring 29 which is slipped onto the bearing pin 26 and clamped between the yoke 27 and a head at the outer end of the bearing pin.

The yoke 27 is U-shaped and has outwardly directed abutment flanges 30 at the outer ends of the U-legs. The abutment flanges are adapted to cooperate with inwardly projecting abutment surfaces 31, if the yoke has been inclined in an attempt at effecting a discharge of bulk goods from the pocket 21 to the bag P.

At the bottom, the operating handles 15*a*, 15*b* are pivotally mounted on pivot pins 32. Between each handle and the yoke extends a link arm 33*a*, 33*b*. One end of the link arm is pivotally connected to the associated handle 15*a*, 15*b* at a suitable distance from the corresponding pivot pin 32, in this case approximately at half the height of the handle. The other ends of the link arms are pivotally connected to one U-leg each of the yoke.

With a view to preventing emptying of bulk goods from the dispenser, a locking means is preferably provided. In the embodiment according to FIGS. 1–3, this locking means comprises two hook means 34, which are pivotally mounted on a pivot pin 35 at the bottom of the discharge chute 14. At the other end of the hook means 34 there are hooks which engage the upwardly bent flange portion 24 of the valve flap when this flange portion is located in its resting position (full lines in FIG. 3). If a bag is moved up behind the discharge chute and surrounds this, the two hook means 34 will be raised from the flange portion 24 for releasing the valve flap. The hook means 34 can be connected to each other and to the pivot pin 35, thereby forming a pivotable bracket. In such a case, it may be sufficient for one leg of the bracket to have a hook at its outer end. If two separate and independently pivotable hook means are used, additional safety is achieved by the fact that discharge of the bulk goods is obtained merely if the collecting receptacle or bag has released the two hook means 34.

For a pivoting of the valve flap to be possible, the two handles 15*a*, 15*b* must be pressed inwardly synchronously with each other, such that the yoke 27 and its abutment flanges 30 should be able to pass the two abutment surfaces 31. If one handle is pressed more than the other, the yoke will be inclined, in which case the abutment flange 30 on that side of the yoke which has been pressed furthest inwards will be stopped in its inward movement by the abutment flange 30 getting caught on the corresponding abutment surface 31. As a result, the compression spring 29 will not be compressed to a sufficient extent for the valve to be pivoted about the pin 19.

Primarily, the compression spring 29, however, is an overload protecting means, which is compressed but to a small extent in normal operation. If, after all, bulk goods should get caught between the valve flap 18 and the free end of the wall 12, i.e. in the opening 17, the compression spring 29 will absorb the forces in continued pressing of the handles 15, thereby preventing the dispenser from being damaged.

In the embodiment according to FIGS. 1–3, there is thus a yieldable connection between the operating arm 25 and the operating yoke 27.

Figure 4:
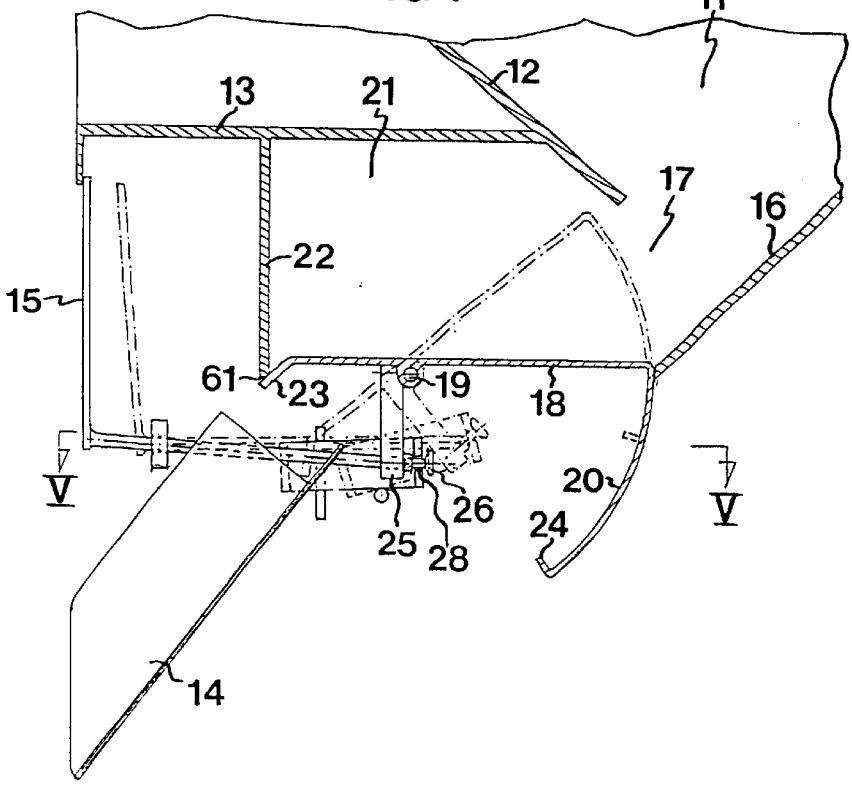
FIG. 4 is a vertical section of a modified mechanism in a second embodiment of the invention.
Figure 5:
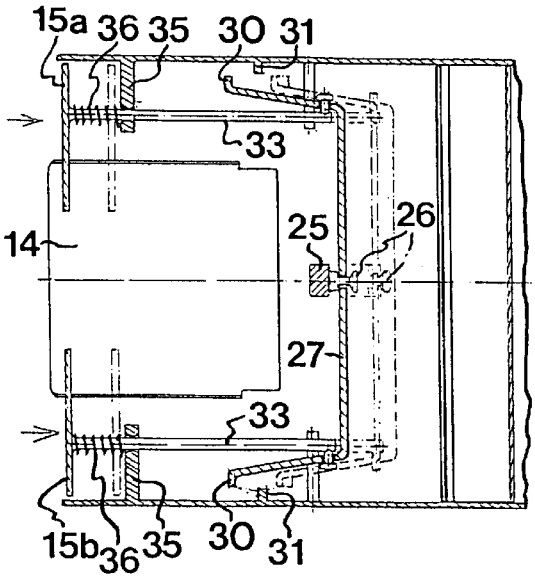
FIG. 5 is a sectional view along line V—V in FIG. 4.
Figure 6:
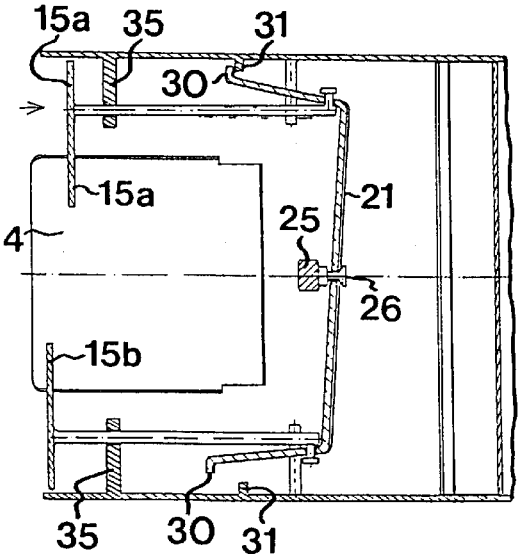
FIG. 6 is the same sectional view as FIG. 5, but shows the components in a position which prevents emptying.

In the modified embodiment shown in FIGS. 4–6, there is instead a direct connection between the yoke 27 and the operating arm 25 by the bearing pin 26 being shorter and ending just above the knife edge hole 28 in the yoke 27. In this modified embodiment, the link arms 33 extend through guide holes in inwardly projecting guide hole brackets 35 in the casing. For returning the valve flap 18 in this embodiment, use can advantageously be made of compression springs 36 which are inserted between the back of the handles 15*a*, 15*b* and the guide hole brackets 35. Otherwise this embodiment of the invention is similar to the one according to FIGS. 1–3. The function of the yoke 27 will be evident when comparing FIGS. 4 and 5.

FIG. 7 illustrates a simplified embodiment of the invention. In this case, the two pivotable handles 15*a*, 15*b* have been replaced by a pulling handle 37, which via a link arm 38 is connected to an upwardly projecting operating arm 25 on the valve flap 18. As for the rest, this embodiment functions in the same way as the embodiments according to FIGS. 1–6.

FIGS. 8 and 9 illustrate a further embodiment, in which two operating handles 40 must be operated synchronously to achieve the intended discharge. In this case, the outer ends of an operating yoke 39 are directly and pivotally connected to the operating handles 40, which are operatively actuated outwards by means of compression springs 41. The yoke has a projection 42, which in correct pressing of the handles (i.e.

approximately synchronous) will press against the downwardly projecting operating arm 43. This has an abutment surface 44 which extends outwards from the operating arm and is designed in such manner that the underside of the projection 42 of the yoke permanently engages the abutment surface 44 independently of the pivoting position of the yoke and independently of the pivoting position of the valve flap. In FIGS. 8 and 9, the resting positions of the valve and the yoke are indicated by full lines, whereas they are indicated by dash-dot lines in the open position of the valve. FIG. 9 shows the relative positions of the yoke 39 and the valve 18 also when the yoke is inclined (position 39'), such that its projection 42' will not hit the operating arm 43 during the inwards movement. In this case, there is, however, still contact between the underside of the projection 42 and the abutment surface 44.

Figure 10:
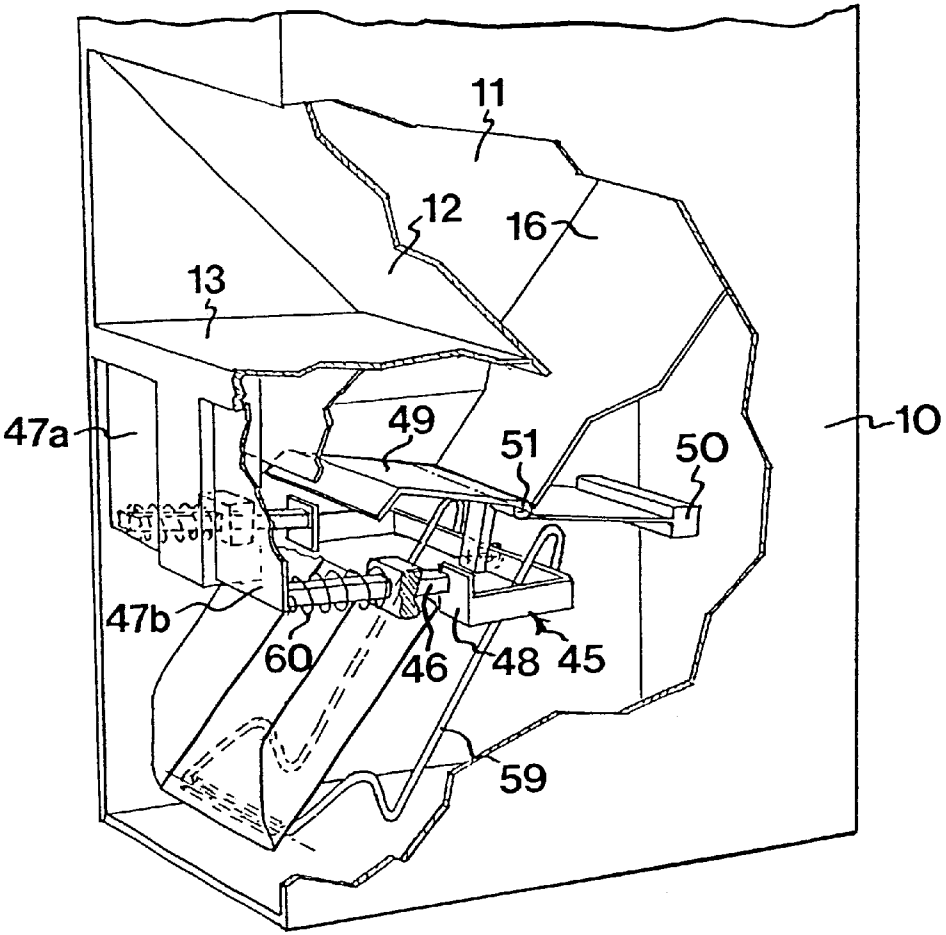
FIG. 10 illustrates a fifth embodiment of a dispenser according to the present invention.

FIG. 10 shows an embodiment which permits continuous discharge of the bulk goods through the discharge chute, but which still has the safety devices described above, i.e. the sensor device for the collecting receptacle (bag or some other receptacle) and two-handed operation. In this case, the yoke 45 is directed forwards so as to be actuated by the end surfaces of backwards projecting operating rods 46 on the handles 47*a*, 47*b*. The legs of the yoke have surfaces 48 of such a lateral extent that an inclination of the yoke causes cancellation of the engagement between the operating rod 46 and the corresponding surface 48 which have been pushed in the shortest distance if the pressing-in does not occur synchronously. The sensor means for correct placing of the packing have in this case the form of a bracket 59, which is pivotally mounted at the lower end of the discharge chute 14 and which at its free end engages behind the yoke 45. In contrast to the embodiments described above, the valve flap 49 does not have the arcuate flange 20, which in the embodiments described above serves as a closing valve for interrupting the flow of goods from the container to the discharge pocket. This is the reason why in this embodiment it is possible to provide a constant and controlled flow (the size of the flow is determined by the extent at which the valve 49 is pivoted).

For the return of valve to its starting position or closing position, use is made of a counterweight 50, which is rigidly connected to the valve and is positioned on the opposite side of the pivot axis 51 of the valve. The presence of a counterweight also yields resistance to the pressing of the handles, which may be advantageous from the point of view of operation. The return of the handles 47*a*, 47*b* to the starting position is also in this case effected by means of compression springs 60.

The operating mechanisms which are shown in the other embodiments can, of course, also be used in embodiments which like the one according to FIG. 10 permit continuous and controlled discharge of the bulk goods.

Figure 11:
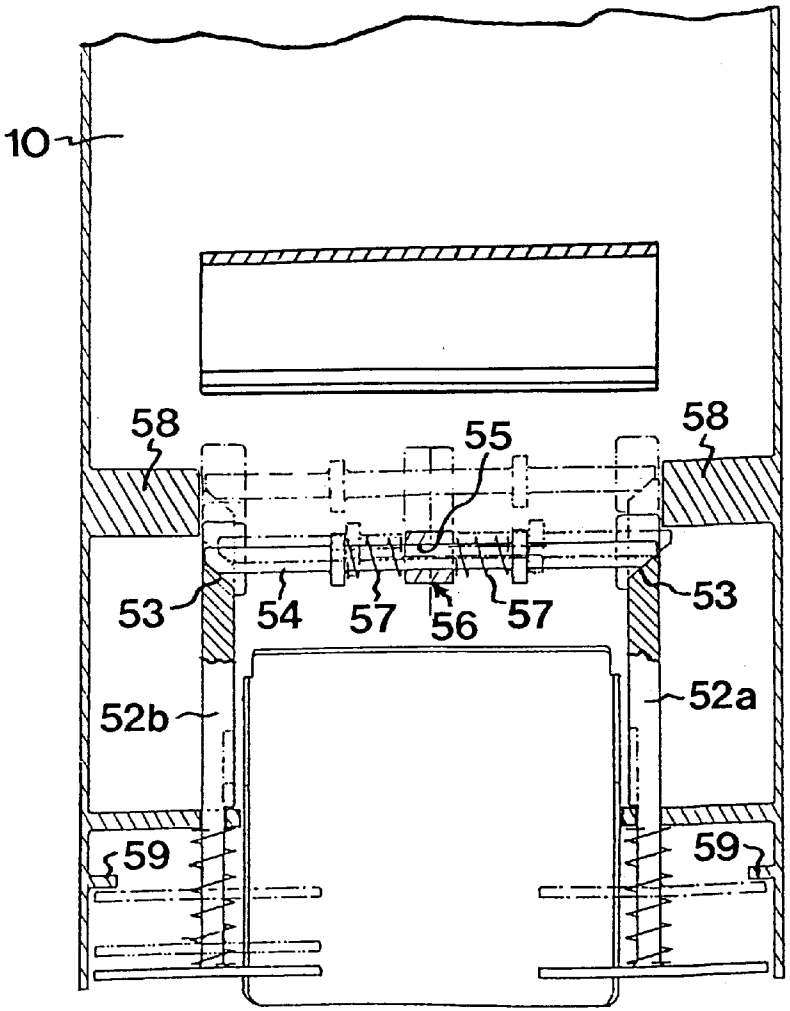
FIG. 11 illustrates a sixth embodiment of a dispenser according to the present invention.

In the embodiments described above, use is made of an inclinable yoke to ensure that the discharge of goods occurs merely if the two operating handles are actuated and such actuation occurs essentially synchronously. In the embodiment according to FIG. 11, use is made of a different type of mechanism to achieve the same function. In this case, the inner ends of the operating rods 52 of the two handles are formed with inclined surfaces 53. These surfaces act upon a movable slide rod 54 which is mounted in a through hole 55 in the operating arm 56 of the valve flap and which is operatively actuated towards a neutral position (full lines) by means of compression springs 57. If one operating rod 52, for instance, the rod 52*b*, is pushed in before the other rod 52*a*, the engagement between the inclined surface 53 of this rod and the corresponding end of the slide rod 54 will cause a movement of the slide rod away from the rod 52*b*. As a result, the slide rod will engage an inwardly projecting stop abutment 58 on the inside of the casing 10. Consequently, the valve flap is prevented from pivoting to an open position. FIG. 11 also shows stop abutments 59 for limitating the extent at which the two handles can be pushed in.

In the embodiments shown, the discharge chute has been formed as an upwardly open chute. Within the scope of the invention, it is also possible to use tubular discharge chutes.

In the embodiment according to FIGS. 10 and 11, use is made of the counterweight 20 to promote the return of the valve flap 18 to its starting position or closed position. Such a counterweight can be used also in the other embodiments shown and disclosed. Alternatively, the counterweight can be replaced by a suitable return spring, which presses the valve flap in the closing direction and whose spring force therefore must be overcome when pressing the operating handle or handles.

What is claimed is:

1. A dispenser for distributing bulk goods comprising a storage container and a discharge device connected thereto and having a dosing means and a discharge chute extending to a collection point, wherein the dosing means comprises a valve flap, the valve flap being pivotable between a closing position, in which the valve flap closingly engages a valve surface, and a discharge position, in which this engagement is cancelled, and which is connected to an operating device, and a locking means for locking the movement of the valve flap from the closing position to the discharge position in the absence of placement a collecting receptacle or bag at a position adjacent the collecting point wherein bulk goods are received into the receptacle or bag, and wherein the locking means may be unlocked independently of the operating device by placement of a receptacle or bag at the position adjacent the collecting point and then using the operating device independent of the locking means to cause movement of the flap valve from the closing position to the discharge position and resultant discharge of bulk goods into the receptacle or bag so that bulk goods may only be discharged to the collection point by first placing the receptacle or bag at the position adjacent the collecting point so as to unlock the locking means and then independently actuating the operating device to cause bulk goods to be discharged to the collection point.

2. A dispenser as claimed in claim 1, wherein the locking device comprises a pivotable packing-sensing element with locking means, which in the absence of a collecting receptacle or bag at the collecting point prevent the valve flap from pivoting and in the presence of the receptacle or bag permit the valve flap to pivot.

3. A dispenser as claimed in claim 1, wherein the dosing means comprises a compartment which receives bulk goods through a flow opening between the dosing compartment and the container when the pivotable valve flap is located in its closing position, and wherein the valve flap at its end opposite to the valve surface has an arcuate extension for closing the flow opening during the emptying of the content of the dosing compartment into the collecting receptacle or bag.

4. A dispenser as claimed in claim 1, wherein the valve flap has a front edge portion angled obliquely downwards by means of which the valve flap engages the valve surface.

5. A dispenser for distributing bulk goods comprising a storage container and a discharge device connected thereto and having a dosing means and a discharge chute extending to a collection point, wherein the dosing means comprises a valve flap, the valve flap being pivotable between a closing position, in which the valve flap closingly engages a valve surface , and a discharge position, in which this engagement is cancelled, and which is connected to an operating device, and a locking means for locking the movement of the valve flap from the closing position to the discharge position in the absence of a collecting receptacle or bag at the collecting point, wherein the operating device for the valve flap comprises two operating handles, which are operatively connected to the valve flap for pivoting thereof, and wherein the operative connection comprises a sensor mechanism, which has abutment surfaces for permitting power transfer when the operating handles are actuated synchronously with each other.

6. A dispenser as claimed in claim 5, wherein the operating handles are arranged on opposite sides of the discharge chute at a higher level than the sensor mechanism.

7. A dispenser as claimed in claim 5, wherein the sensor mechanism comprises a yoke, the yoke being pivotally attached at its center to an operating arm on the valve flap and the ends of said yoke each being connected to one of the operating handles each, and wherein the abutment surfaces are adapted to prevent power transfer from the yoke to the operating arm if the yoke is inclined by asynchronous actuation of the two operating handles.

8. A dispenser as claimed in claim 5, wherein the locking means comprise a guide surface formed on the operating handles and adapted to engage a locking slide included in the locking means and movably arranged on the operating arm for displacement substantially perpendicular to the moving direction of the operating handles, said locking slide being adapted, when the operating handles are asynchronously actuated, to be moved into engagement with a stop abutment surface for interrupting movement of the operating arm.

9. A dispenser as claimed in claim 8, wherein the locking slide is operatively loaded towards a neutral position, in which the ends of the slide, when the operating arm is actuated by essentially synchronous acutation of both operating handles, move clear of their respective stop abutment surfaces.

10. A dispenser as claimed in claim 5, wherein the disengaging means comprises a projection which is arranged on the pivotable yoke and which is arranged relative to the operating arm so as to be drivingly engaged with the operating arm only upon essentially synchronous displacement of the operating handles.

* * * * *

UNITED STATES PATENT AND TRADEMARK OFFICE

CERTIFICATE OF CORRECTION

PATENT NO. : 6,220,313 B1
DATED : April 24, 2001
INVENTOR(S) : Peter Estlander

It is certified that error appears in the above-identified patent and that said Letters Patent is hereby corrected as shown below:

Column 1,
Line 2, after "number", delete "PCTE98/00283" and insert therefore
-- PCT/SE98/00283 --.

Signed and Sealed this

Twenty-second Day of January, 2002

*Attest:*

*Attesting Officer*

JAMES E. ROGAN
*Director of the United States Patent and Trademark Office*